US008094854B2

(12) United States Patent
Dodd

(10) Patent No.: US 8,094,854 B2
(45) Date of Patent: Jan. 10, 2012

(54) LOUDSPEAKER

(75) Inventor: Mark Dodd, Woodbridge (GB)

(73) Assignee: KH Technology Corporation, George Town (KY)

( * ) Notice: Subject to any disclaimer, the term of this patent is extended or adjusted under 35 U.S.C. 154(b) by 933 days.

(21) Appl. No.: 11/885,539

(22) PCT Filed: Mar. 2, 2006

(86) PCT No.: PCT/GB2006/000753

§ 371 (c)(1),
(2), (4) Date: Apr. 21, 2008

(87) PCT Pub. No.: WO2006/092609

PCT Pub. Date: Sep. 8, 2006

(65) Prior Publication Data

US 2009/0041280 A1 Feb. 12, 2009

(30) Foreign Application Priority Data

Mar. 2, 2005 (GB) ..... 0504248.6

(51) Int. Cl.
*G10H 1/00* (2006.01)

(52) U.S. Cl. ..... 381/344; 381/340

(58) Field of Classification Search ..... 381/300–344
See application file for complete search history.

(56) References Cited

U.S. PATENT DOCUMENTS

| | | | |
|---|---|---|---|
| 4,531,608 | A | 7/1985 | Heinz et al. |
| 5,285,025 | A | 2/1994 | Yoshioka et al. |
| 5,548,657 | A | 8/1996 | Fincham |
| 5,907,133 | A | 5/1999 | Agostinelli et al. |
| 6,757,404 | B2 | 6/2004 | Takewa et al. |
| 2002/0061117 | A1 | 5/2002 | Takewa et al. |
| 2002/0094107 | A1 | 7/2002 | Cork |
| 2004/0202342 | A1 | 10/2004 | Anthony et al. |

FOREIGN PATENT DOCUMENTS

| | | | |
|---|---|---|---|
| DE | 3018659 | A1 | 11/1981 |
| EP | 1173042 | A2 | 1/2002 |
| EP | 1515583 | A1 | 3/2005 |
| FR | 2428952 | A3 | 4/1978 |

(Continued)

OTHER PUBLICATIONS

The Patent Office, Search Report for Patent Application No. GB0504248.6 dated on May 17, 2005, 3 pages.

(Continued)

*Primary Examiner* — David S. Warren

(74) *Attorney, Agent, or Firm* — Kenneth L. Sherman, Esq.; Michael Zarrabian, Esq.; Myers Andras Sherman & Zarrabian LLP

(57) ABSTRACT

A loudspeaker comprises a horn waveguide having a waveguide surface, and a transducer located in, or adjacent to, a throat of the horn waveguide. The transducer has a substantially rigid convex dome-shaped acoustically radiating surface. A horn angle subtended between a longitudinal axis of the horn waveguide and the waveguide surface at the throat of the horn, is in the range 20 to 60 degrees. An intersection angle subtended between a plane tangential to the dome shape of the acoustically radiating surface and a plane tangential to the waveguide surface at a point where the dome shape or an extrapolation of the dome shape meets the waveguide surface or an extrapolation of the waveguide surface, is in the range 85 to 110 degrees.

25 Claims, 15 Drawing Sheets

FOREIGN PATENT DOCUMENTS

| | | | |
|---|---|---|---|
| GB | 2166023 | A | 4/1986 |
| GB | 2261135 | A | 5/1993 |
| GB | 2364847 | A | 2/2002 |
| GB | 2377849 | A | 1/2003 |
| GB | 0504274.2 | | 3/2005 |
| JP | S53-122932 | U | 3/1977 |
| JP | S54-164546 | U | 5/1978 |
| JP | S57-152792 | A | 9/1982 |
| JP | 60171897 | | 5/1985 |
| JP | 02 238798 | A | 9/1990 |
| JP | H02-288499 | A | 11/1990 |
| JP | H07-030993 | A | 1/1995 |
| JP | 2003153366 | A | 5/2003 |
| WO | WO 2004/089037 | A1 | 10/2004 |

OTHER PUBLICATIONS

PCT International Search Report, PCT/GB2006/00753, dated Jun. 26, 2006.

PCT Written Opinion of the International Searching Authority, PCT/GB2006/000753.

Japanese Office Action mailed Jan. 4, 2011 for Japanese Patent Application No. 2007-557591 from Japan Patent Office, 3 pages, Japan (English-language translation included, 7 pages).

PCT International Search Report for International Application No. PCT/GB2006/00737 dated Jun. 26, 2006, 3 pgs.

The Patent Office (United Kingdom), Search Report for Patent Application No. GB0504274.2 dated on May 18, 2005, 3 pages.

20 Degree horn angle 80 deg intersection angle: on axis 85 deg intersection angle: on axis 90 deg intersection angle: on axis 100 deg intersection angle: on axis 110 deg intersection angle: on axis 80 deg intersection angle: on axis - off axis 90 deg intersection angle: on axis - off axis 110 deg intersection angle: on axis - off axis 30 Degree horn angle 35 Degree horn angle 80 deg intersection angle: on axis 85 deg intersection angle: on axis 90 deg intersection angle: on axis 100 deg intersection angle: on axis 110 deg intersection angle: on axis 80 deg intersection angle: on axis - off axis 90 deg intersection angle: on axis - off axis 110 deg intersection angle: on axis - off axis 40 Degree horn angle 80 deg intersection angle: on axis 85 deg intersection angle: on axis 90 deg intersection angle: on axis 100 deg intersection angle: on axis 110 deg intersection angle: on axis 80 deg intersection angle: on axis - off axis 90 deg intersection angle: on axis - off axis 110 deg intersection angle: on axis - off axis 50 Degree horn angle 85 deg intersection angle: on axis 90 deg intersection angle: on axis 100 deg intersection angle: on axis 110 deg intersection angle: on axis 120 deg intersection angle: on axis 85 deg intersection angle: on axis - off axis 100 deg intersection angle: on axis - off axis 120 deg intersection angle: on axis - off axis 60 Degree horn angle 85 deg intersection angle: on axis 100 deg intersection angle: on axis 110 deg intersection angle: on axis 130 deg intersection angle: on axis 85 deg intersection angle: on axis - off axis 110 deg intersection angle: on axis - off axis 130 deg intersection angle: on axis - off axis

LOUDSPEAKER

CROSS REFERENCE TO RELATED APPLICATIONS

The present application is a national stage application under 35 U.S.C. 371 of PCT/GB2006/000753 filed Mar. 2, 2006, which claims priority of GB 0504248.6 filed Mar. 2, 2005, both applications being hereby incorporated by reference in their entirety.

BACKGROUND OF THE INVENTION

The present invention relates to loudspeakers, and particularly relates to dome-shaped transducers, for example high frequency transducers commonly referred to as "tweeters".

BRIEF SUMMARY OF THE INVENTION

High frequency dome-shaped transducers may be operated with or without the presence of a surrounding horn. The horn may be a static horn, or it may itself be an acoustically radiating diaphragm, such as a cone diaphragm, for example. The present invention seeks to provide a loudspeaker utilising a convex dome-shaped transducer, which has improved acoustic properties compared to known arrangements.

Accordingly, the invention provides a loudspeaker comprising a horn waveguide having a waveguide surface, and a transducer located in, or adjacent to, a throat of the horn waveguide, the transducer having a substantially rigid convex dome-shaped acoustically radiating surface, wherein:

(a) a horn angle subtended between a longitudinal axis of the horn waveguide and the waveguide surface at the throat of the horn, is in the range 20 to 60 degrees; and (b) an intersection angle subtended between a plane tangential to the dome shape of the acoustically radiating surface and a plane tangential to the waveguide surface at a point where the dome shape or an extrapolation of the dome shape meets the waveguide surface or an extrapolation of the waveguide surface, is in the range 85 to 110 degrees.

The inventors of the present invention have found that a loudspeaker having the above-defined combination of features is able to generate acoustic waves having a dramatically enhanced consistency over a greater range of frequencies, than hitherto. In particular, the inventors have found that the acoustic waves generated by the loudspeaker of the invention can have a more consistent response over a wider range of frequencies and angles of direction, than known loudspeakers.

The term "sphericity" (with regard to an acoustic wave) is used in this specification to define the degree to which the wavefront of the wave approximates to a segment of a pulsating spherical surface. The sphericity of the acoustic waves generated by a dome-shaped transducer is important for two main reasons. Firstly, the greater the sphericity of an acoustic wave, the more even (generally speaking) will be its directivity, i.e. the sound pressure level produced by the wave will generally be more consistent over its entire wavefront. Secondly, an acoustic wave having a high degree of sphericity will generally avoid significant response irregularities, particularly if the sphericity substantially "matches" the shape of the horn waveguide along which it propagates (e.g. such that the wavefront is substantially perpendicular to the waveguide surface where the wavefront meets the waveguide surface). The present inventors have found (in addition to the findings referred to above) that acoustic waves generated and propagated by loudspeakers according to the invention can have a greater degree of sphericity than those generated and propagated by known loudspeakers comprising a convex dome-shaped transducer and a horn waveguide.

The present inventors have found that especially good acoustic results can be achieved with loudspeakers in accordance with the invention if the intersection angle falls within a preferred range of angles that varies with horn angle in a particular way. Thus, in some preferred embodiments of the invention, for horn angles in the range 20 to 40 degrees, the minimum intersection angle of the range of intersection angles is 85 degrees. Preferably, for horn angles in the range from 40 to 50 degrees, the minimum intersection angle of the range of intersection angles varies substantially linearly from 85 to 90 degrees. Preferably, for horn angles in the range from 50 to 60 degrees, the minimum intersection angle of the range of intersection angles varies substantially linearly from 90 to 100 degrees.

Advantageously, for horn angles in the range from 20 to 45 degrees, the maximum intersection angle of the range of intersection angles preferably varies substantially linearly from 100 to 110 degrees. Preferably, for horn angles in the range 45 to 60 degrees, the maximum intersection angle of the range of intersection angles is 110 degrees.

The acoustically radiating surface of the transducer is dome-shaped. At least in the broadest aspects of the invention, the shape of the dome may be substantially any dome shape, but preferably the acoustically radiating surface of the dome is substantially smooth. In some embodiments of the invention, the dome shape of the acoustically radiating surface is substantially spheroid, e.g. the surface generated by the half-revolution of an ellipse about its major axis. For most embodiments of the invention, however, more preferably, the dome shape of the acoustically radiating surface of the transducer is substantially the shape of a segment of a sphere (i.e. the dome preferably is a substantially spherical dome).

The dome-shaped acoustically radiating surface of the transducer of loudspeakers according to the invention is substantially rigid. Such rigidity may, for example, be achieved by means of the choice of material from which the dome is formed. (Some preferred materials are referred to below.) Additionally or alternatively, the transducer may be reinforced in order to improve or provide its rigidity. A particularly preferred transducer for use in the present invention is disclosed in the UK patent application filed by the present applicant on the same date as the present application, and entitled "Electro-acoustic Transducer". Thus, in some preferred embodiments of the present invention, the transducer comprises a front part having an acoustically radiating surface, a supporting part that supports the front part and that extends from the front part (preferably from a peripheral region of the front part) in a direction away from the acoustically radiating surface, and a reinforcing part that provides rigidity to the transducer. The reinforcing part preferably extends from the supporting part to the rear of the front part such that a portion of the reinforcing part is spaced from the front part and/or the supporting part.

The inventors have also found that other criteria can, at least for some embodiments of the invention, ensure enhanced acoustic properties for the loudspeaker. For example, any separation (in a radial direction substantially perpendicular to the longitudinal axis of the horn waveguide) at any point between the throat of the horn waveguide at the waveguide surface and the dome-shaped acoustically radiating surface of the transducer, preferably is no greater than 2.5 mm, more preferably no greater than 2 mm, e.g. 1.5 mm or less. This preferred criterion may be expressed in another way as follows, or an alternative preferred criterion is as follows:

a minimum diameter of the throat of the horn waveguide at the waveguide surface preferably is no more than 5 mm larger than a maximum diameter of the dome-shaped acoustically radiating surface of the transducer. More preferably, the minimum diameter of the throat of the horn waveguide is no more than 4 mm larger than a maximum diameter of the dome of the transducer, e.g. no more than 3 mm larger. Preferably there are substantially no cavities exhibiting resonances in the audio range between the transducer and the horn waveguide.

In preferred embodiments of the invention, the dome-shaped acoustically radiating surface of the transducer is attached via a surround to a support situated around the transducer, at least part of the surround being flexible. The surround preferably comprises a generally annular web, at least part of the width of which (i.e. in the direction perpendicular to the longitudinal axis of the horn) is flexible, thus allowing for the substantially axial movement of the dome which generates the acoustic waves. Preferably, the dome-shaped acoustically radiating surface of the transducer is spaced apart from the support in a radial direction substantially perpendicular to the longitudinal axis of the horn waveguide, by no more than 2.5 mm, e.g by no more than 2 mm. This preferred criterion may be expressed in another way as follows, or an alternative preferred criterion is as follows: a minimum diameter of the support situated around the transducer preferably is no more than 5 mm larger, e.g. no more than 4 mm larger, than a maximum diameter of the dome-shaped acoustically radiating surface of the transducer.

As mentioned above, the horn angle (subtended between a longitudinal axis of the horn waveguide and the waveguide surface at the throat of the horn) for loudspeakers according to the invention is between 20 degrees and 60 degrees. Preferably, the horn angle is no greater than 55 degrees, especially no greater than 50 degrees. Preferably the horn angle is at least 25 degrees, more preferably at least 30 degrees, especially at least 35 degrees, e.g. 40 degrees.

In at least some embodiments of the invention, the horn waveguide is non-circular in cross-section perpendicular to its longitudinal axis. For example, the horn may be oval in cross-section, or indeed substantially any shape. However, for many embodiments of the invention, the horn waveguide is substantially circular in cross-section perpendicular to its longitudinal axis.

The horn waveguide may be substantially frusto-conical (i.e. the horn waveguide may be substantially conical but truncated at the throat of the horn). However, the horn waveguide may be flared, e.g. flared such that it follows a substantially exponential curve, or a substantially parabolic curve, or another flared curve. Other horn waveguide shapes are also possible.

Preferably the horn waveguide has an axial length of at least 1.5 times the height of the dome of the transducer, more preferably at least 2.0 times the height of the dome of the transducer. The height of the dome of the transducer is defined as being measured along the longitudinal axis of the horn waveguide from the point of intersection of the dome shape of the acoustically radiating surface of the transducer with the waveguide surface (or extrapolations therefrom) to the acoustically radiating surface of the dome where it intersects the longitudinal axis of the horn. (That is, the height of the dome is its height measured along the longitudinal axis of the horn.) The axial length of the horn is defined as being measured along the axis of the horn from the inwardmost edge of the waveguide surface (the throat) to the outwardmost edge of the waveguide surface (the mouth).

As indicated above, the horn waveguide may be a static waveguide, or it may itself be an acoustically radiating diaphragm, e.g a cone diaphragm. Consequently, in some embodiments of the invention, the horn waveguide may comprise a driven acoustically radiating diaphragm. The diaphragm may be driven substantially independently of the dome-shaped transducer, for example such that the diaphragm is arranged to radiate acoustic waves of generally lower frequency than is the dome-shaped transducer. Alternatively, the diaphragm and the dome-shaped transducer may be driven together substantially as a unit, for example. Consequently, the loudspeaker preferably includes one or more drive units to drive the diaphragm and/or the dome-shaped transducer. An example of a suitable arrangement (albeit at least with a different intersection angle to the present invention) in which the horn waveguide itself comprises an acoustically radiating diaphragm, is disclosed in U.S. Pat. No. 5,548,657.

The dome-shaped transducer preferably is formed from a substantially rigid low density material, for example a metal or metal alloy material, a composite material, a plastics material, or a ceramic material. Some preferred metals for forming a suitable metal or metal alloy material include: titanium; aluminium; and beryllium. The acoustically radiating surface of the dome-shaped transducer may be formed from a specialist material, for example diamond (especially chemically deposited diamond).

The horn waveguide may be formed from any suitable material, for example a metal or metal alloy material, a composite material, a plastics material, a fabric material, or a ceramic material. For those embodiments of the invention in which the horn waveguide is an acoustically radiating diaphragm, it preferably is formed from a plastics material or a fabric material, for example. Metal or paper may be preferable in some cases.

In some embodiments of the invention, the loudspeaker may include one or more further transducers and/or driven acoustically radiating diaphragms, for example.

A second aspect of the invention provides a loudspeaker system comprising a plurality of loudspeakers according to the first aspect of the invention.

Other preferred and optional features of the invention are described below and in the dependent claims.

BRIEF DESCRIPTION OF THE DRAWINGS

Examples of some preferred embodiments of the invention will now be described, by way of example, with reference to the accompanying drawings, of which.

DETAILED DESCRIPTION OF THE PREFERRED EMBODIMENTS

Figure 1:
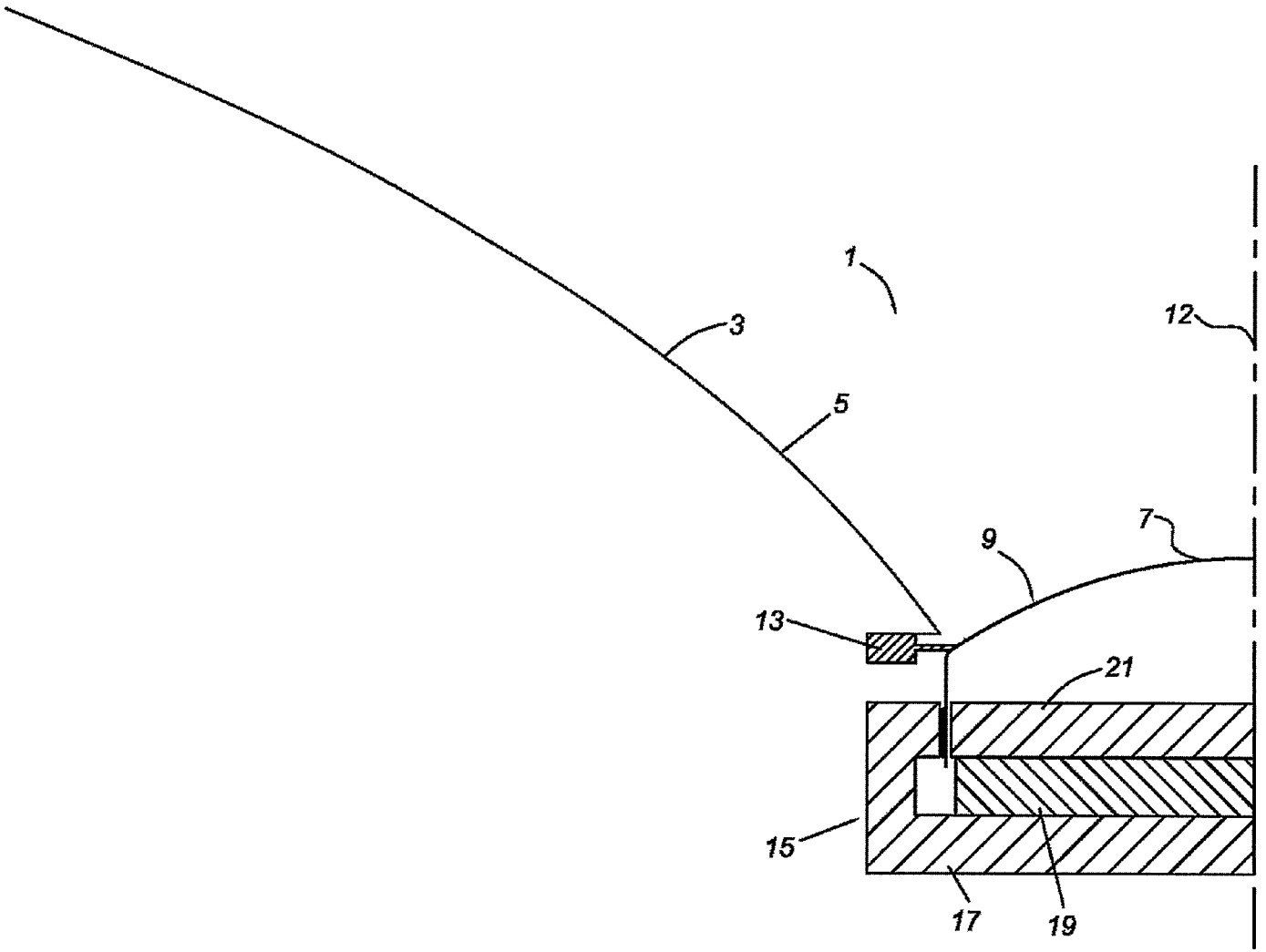
FIG. 1 shows, schematically and in cross-section, part of a loudspeaker according to the present invention.
Figure 2:
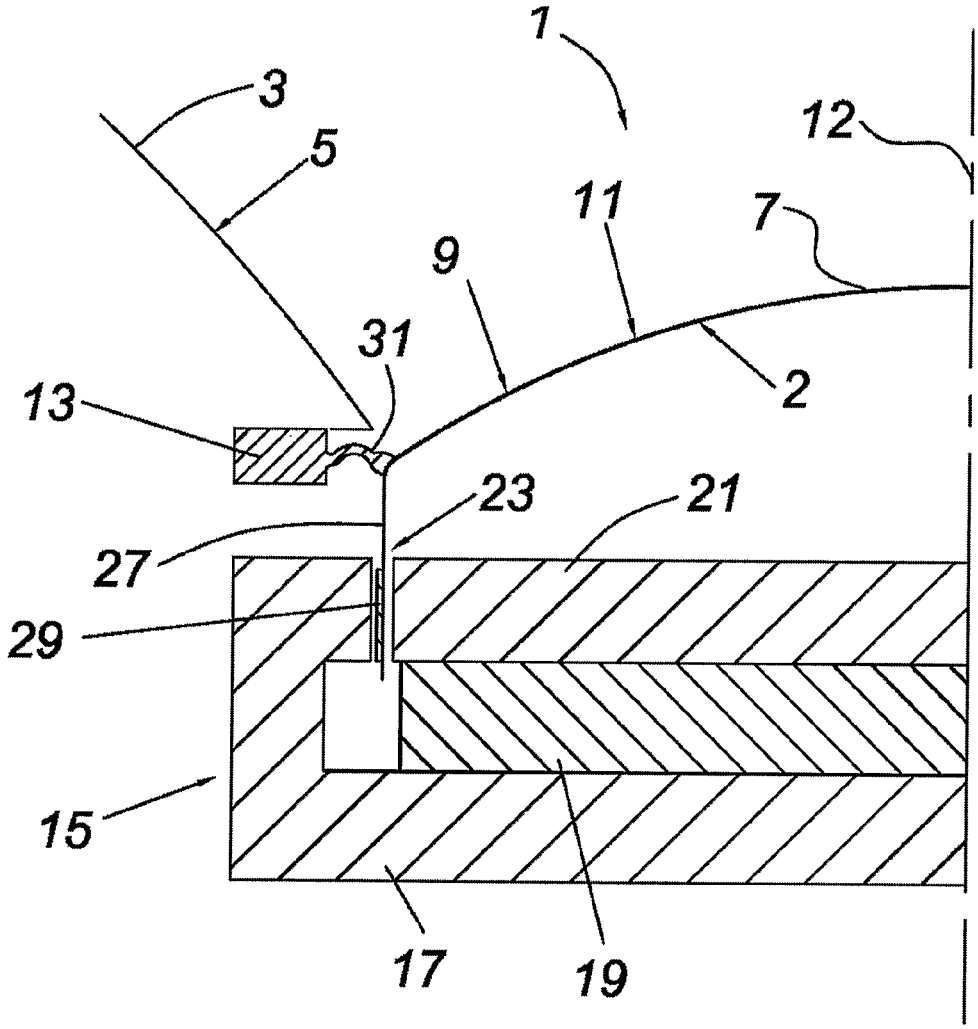
FIG. 2 shows a detail of FIG. 1.

FIGS. 1 and 2 show, schematically and in cross-section, part of a loudspeaker 1 according to the present invention. (Both figures show only one half of the loudspeaker on one side of a longitudinal axis 12. The loudspeaker is symmetrical about the axis.) The loudspeaker 1 comprises a horn waveguide 3 having a waveguide surface 5, and a convex dome-shaped transducer 7 located generally in the throat 9 of the horn waveguide. The convex dome-shaped transducer 7 has a substantially rigid acoustically radiating surface 11, which is shaped substantially as a segment of a sphere (i.e. the curvature of the surface 11 is a substantially spherical curvature). The horn waveguide 3 is a generally frusto-conical flared static waveguide having a longitudinal axis 12. A surround 31 of the dome-shaped transducer 7 is attached to a support 13 behind the throat 9 of the horn waveguide 3.

A drive unit 15 of the dome-shaped transducer 7 comprises a pot 17, a disc-shaped magnet 19 and a disc-shaped inner pole 21. The pot 17 is substantially cylindrical and has an opening 23 to receive the disc-shaped magnet 19 and the inner pole 21. The opening 23 is defined by a radially-inwardly extending lip 25 that forms an outer pole of the drive unit 15. A substantially cylindrical former (or support) 27 of the dome-shaped transducer 7 carries a coil 29 of an electrical conductor (e.g. a wire) that is wound around the former 27. The coil 29 and former 27 extend between the inner and outer poles 21 and 25 of the drive unit. The dome-shaped transducer 7 is driven substantially along the axis 12 by the drive unit, and is stabilized by the flexible surround 31. Preferably at least the outer 50% of the radial width of the surround 31 is overlapped by the throat 9 of the horn waveguide.

Figure 3:
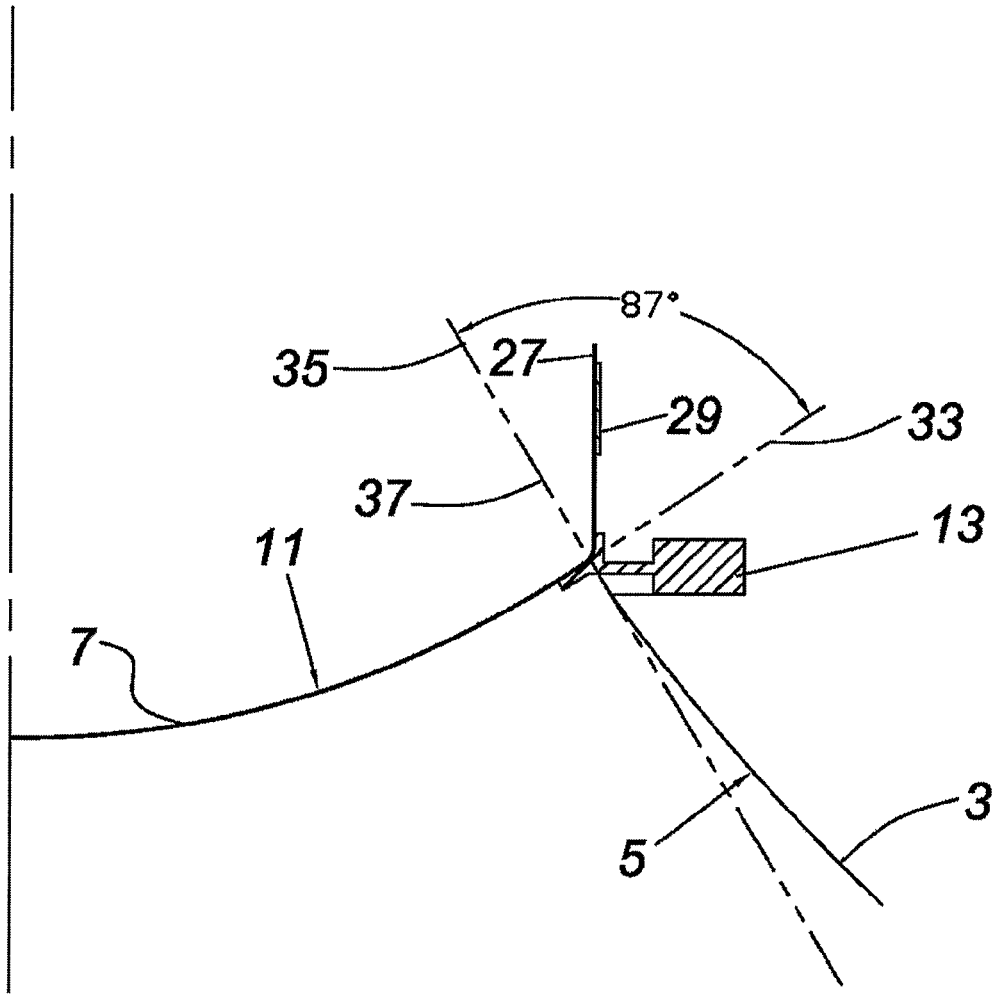
FIG. 3 is a schematic illustration of the "intersection angle" (as defined herein) of a loudspeaker according to the invention.
Figure 4A:
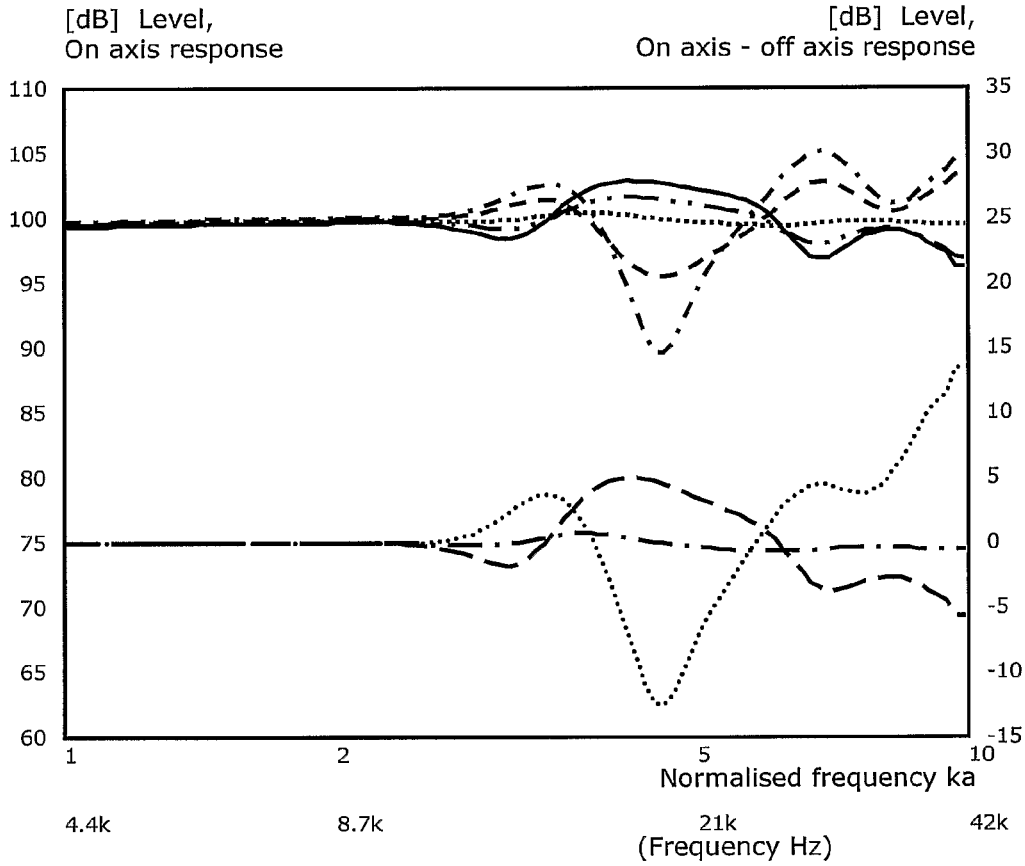
FIG. 4((*a*) to (*f*) shows graphical representations of sound pressure level (in dB) versus sound frequency (in Hz, and also in normalised wave number ka) modelled for a loudspeaker according to the invention at six differing horn angles, and at various differing intersections angles for each horn angle.
Figure 4B:
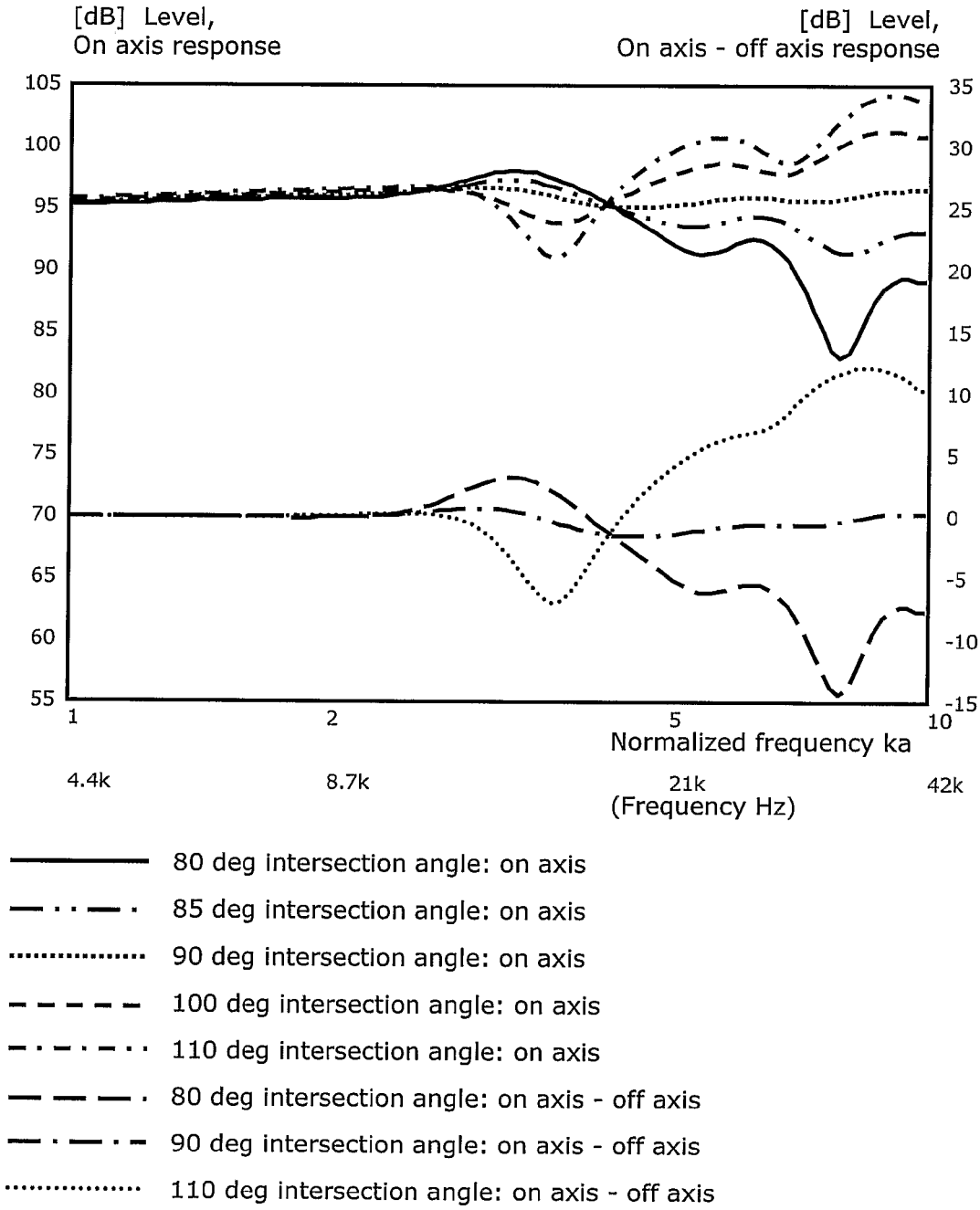
Figure 4C:
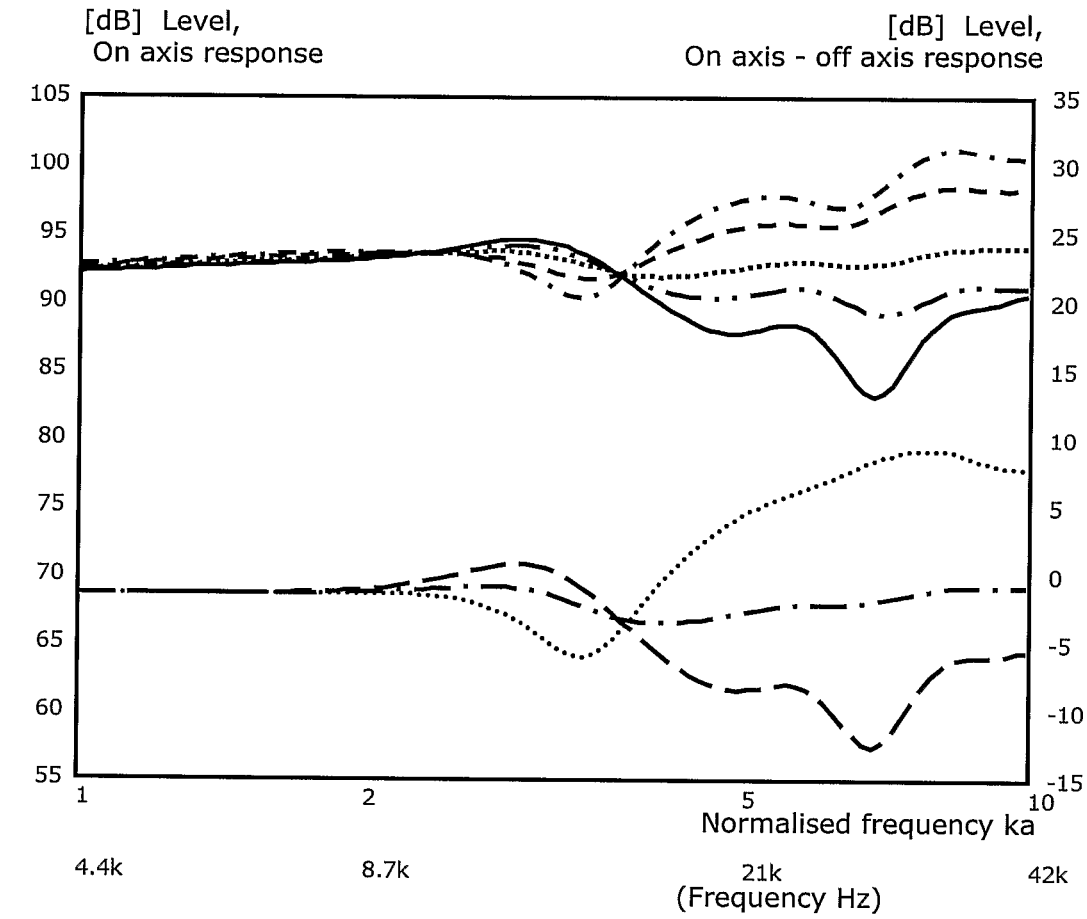
Figure 4D:
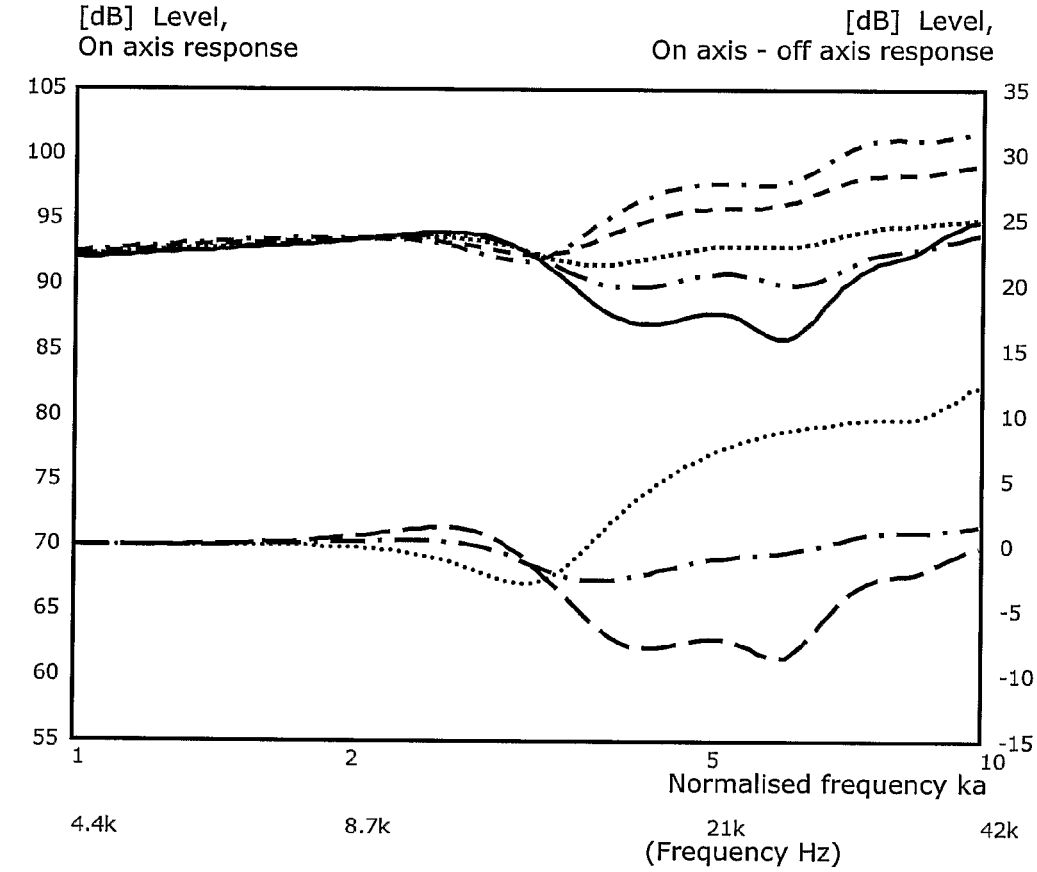
Figure 4E:
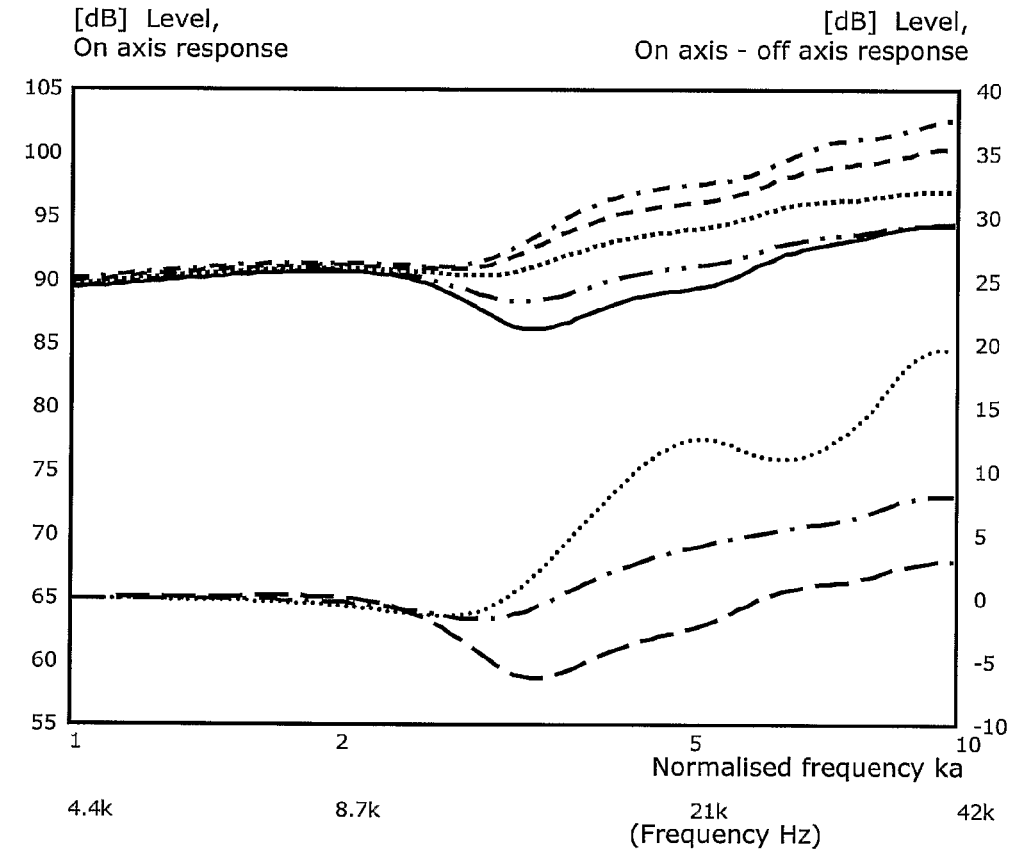
Figure 4F:
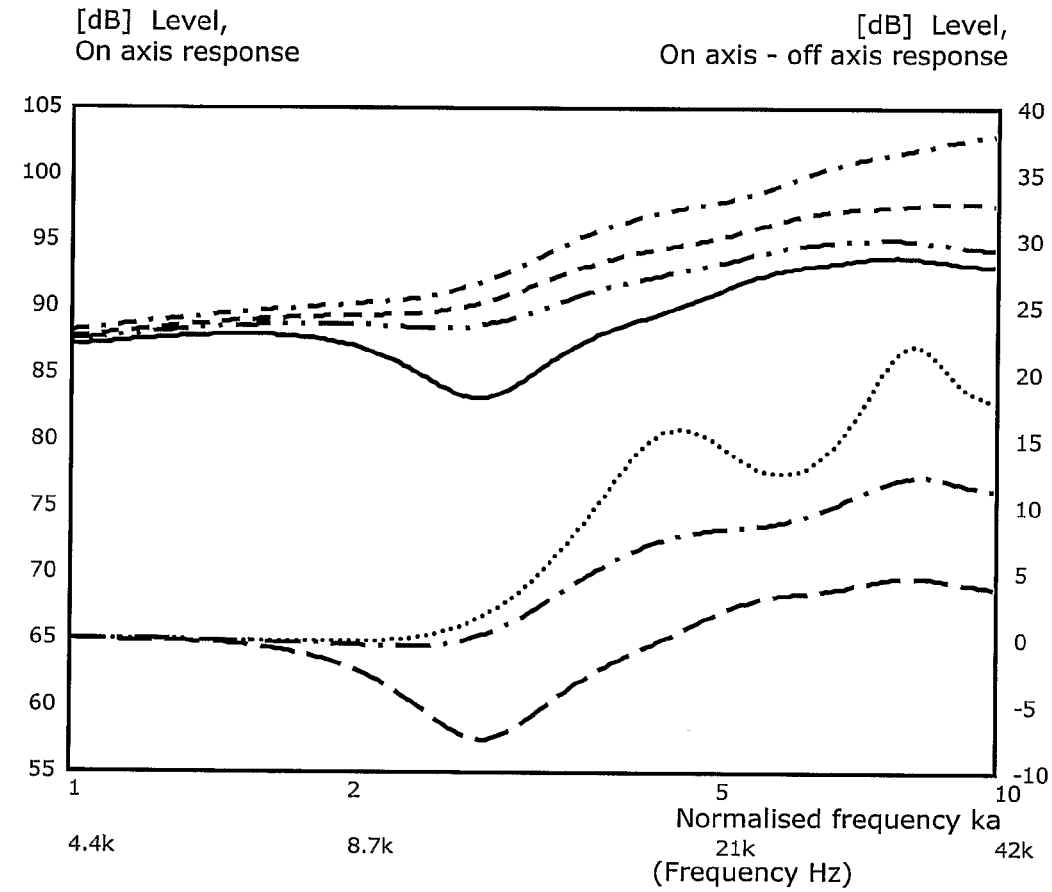

FIG. 3 is a schematic illustration of the "intersection angle" (as defined herein) of a loudspeaker according to the invention. As illustrated, the intersection angle is an angle subtended between a 33 tangential to the spherical curvature of the acoustically radiating surface 11 and a plane 35 tangential to the waveguide surface 5 of the horn waveguide 3 at a point where the spherical curve meets an imaginary surface 37 extrapolated from the waveguide surface. The intersection angle illustrated in FIG. 3 is 87 degrees, as indicated.

FIG. 4 shows graphical representations of the results of finite element analysis computer modelling of sound pressure level (in dB) versus sound frequency (in Hz) modelled for a loudspeaker according to the invention at six differing horn angles and at various intersection angles. The computer modelling assumed, for simplicity, that the convex dome-shaped transducer had an acoustically radiating surface in the shape of a segment of a sphere, and that the surface was driven along the longitudinal axis of an infinitely extending conical horn waveguide.

As the skilled person knows, in order for a loudspeaker to perform adequately it is necessary for the sound pressure level of sounds produced by the loudspeaker to be as smooth and loud as practicable (for a given input power) over substantially the entire operating sound frequency range of the loudspeaker. For preferred loudspeakers according to the invention, the operating frequency range will normally be from about 2 kHz to about 20 kHz (or possibly higher; for Super Audio Compact Disc (SACD) systems, for example, the operating frequency range extends above 20 kHz). It is therefore desired for loudspeakers according to the invention to have a sound pressure level response over this frequency range that is as smooth and loud as possible. As the skilled person also knows, the sound pressure level will normally vary (for a particular loudspeaker) with the direction relative to the loudspeaker at which the sound pressure level is measured (or modelled). Consequently, the computer modelling of the present invention was carried out at two principle "directions" relative to the dome-shaped transducer, namely "on-axis" and at the waveguide surface of the horn.

FIGS. 4(*a*) to 4(*f*) show the results of the modelling for a horn waveguide having a horn angle of 20, 30, 35, 40, 50 and 60 degrees, respectively, and at various differing intersection angles for each horn angle. In each case, as mentioned above, the sound pressure level ("SPL") was modelled on the longitudinal axis of the horn ("on-axis"), and at the waveguide surface of the horn ("off-axis"). Each graph shows an upper series of plots, and a separate lower series of plots, each plot comprising modelling results for a particular specified horn angle and a particular specified intersection angle. The upper series show the modelling results for the on-axis SPL, and the lower series show the difference between the on-axis and the off-axis modelling results at each of three of the intersection angles.

Each plot shown in FIG. 4 is a plot of sound pressure level (in dB) versus sound frequency (in Hz). The results shown are for a 25 mm throat diameter and a 25 mm diameter dome-shaped acoustically radiating surface. However, the plots are also shown as sound pressure level (in dB) versus normalised wave number (ka):

$$ka = \frac{2\pi}{\lambda} r$$

where:

r=throatradius

λ=acousticwavelength

Additionally, the normal tilt (inclination) of each SPL plot has been substantially levelled by applying a 6 dB octave slope to the plot, so that any departures from a substantially straight line plot are clearly shown.

The modelling results illustrated graphically in FIG. 4 clearly show that for the modelled loudspeakers that fall within the scope of the present invention, i.e. having an intersection angle in the range of 85 degrees to 110 degrees and a horn angle in the range of 20 to 60 degrees, the sound pressure level response both "on-axis" and at the horn waveguide surface is significantly smoother than it is for those modelled loudspeakers falling outside the defined range of intersection angles, i.e. outside the scope of the invention. For those intersection angles falling within the preferred ranges of intersection angles, the modelled sound pressure level response is very significantly smoother than for intersection angles falling outside the scope of the invention.

Figure 5:
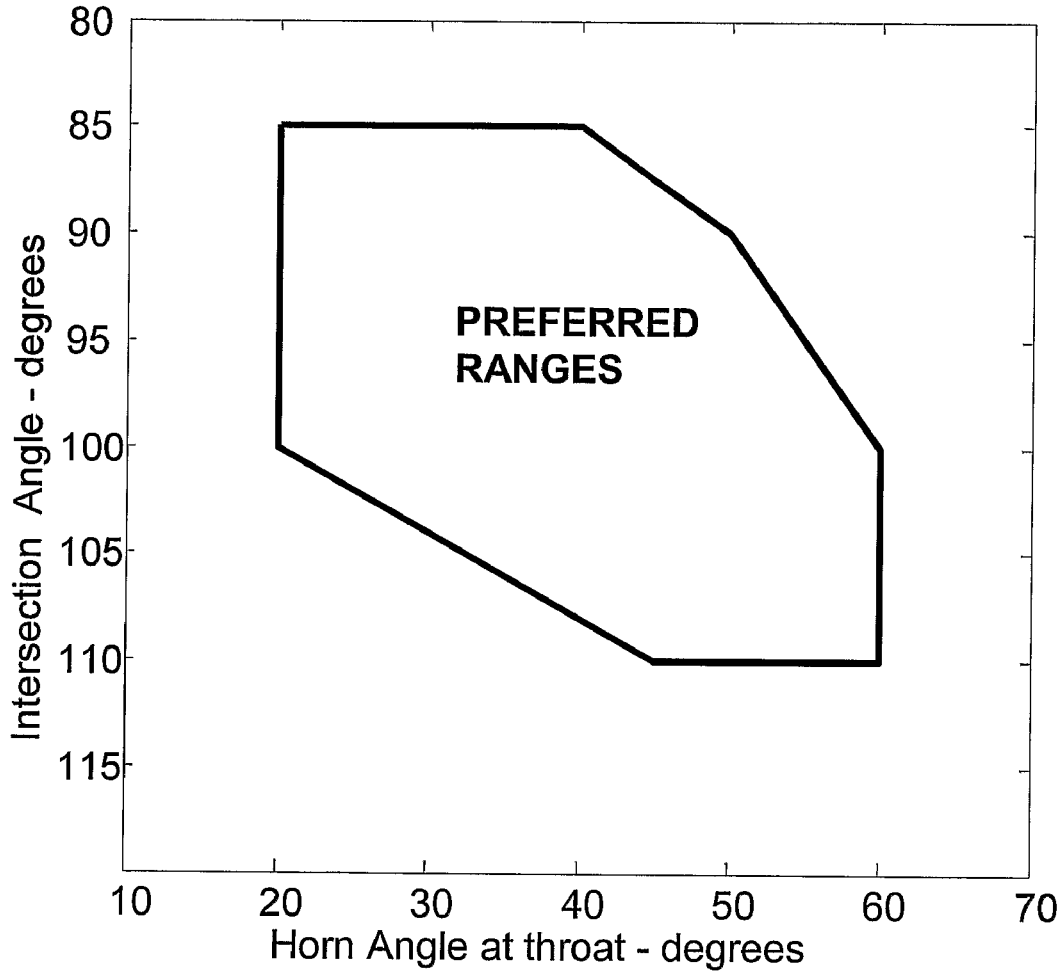
FIG. 5 is a graphical representation showing some preferred ranges of intersection angle as a function of horn angle, for loudspeakers according to the invention.

The preferred ranges of intersection angles at various horn angles have been referred to above. In summary, these are as follows. For horn angles in the range 20 to 40 degrees, the minimum intersection angle of the range of intersection angles is 85 degrees. For horn angles in the range from 40 to 50 degrees, the minimum intersection angle of the range of intersection angles preferably varies substantially linearly from 85 to 90 degrees. For horn angles in the range from 50 to 60 degrees, the minimum intersection angle of the range of intersection angles preferably varies substantially linearly from 90 to 100 degrees. For horn angles in the range from 20 to 45 degrees, the maximum intersection angle of the range of intersection angles preferably varies substantially linearly from 100 to 110 degrees. For horn angles in the range 45 to 60 degrees, the maximum intersection angle of the range of intersection angles is 110 degrees. These preferred ranges are illustrated graphically in FIG. 5. The preferred intersection angles at each horn angle fall at the boundary of, or within, the area shown on the graph.

Figure 6A:
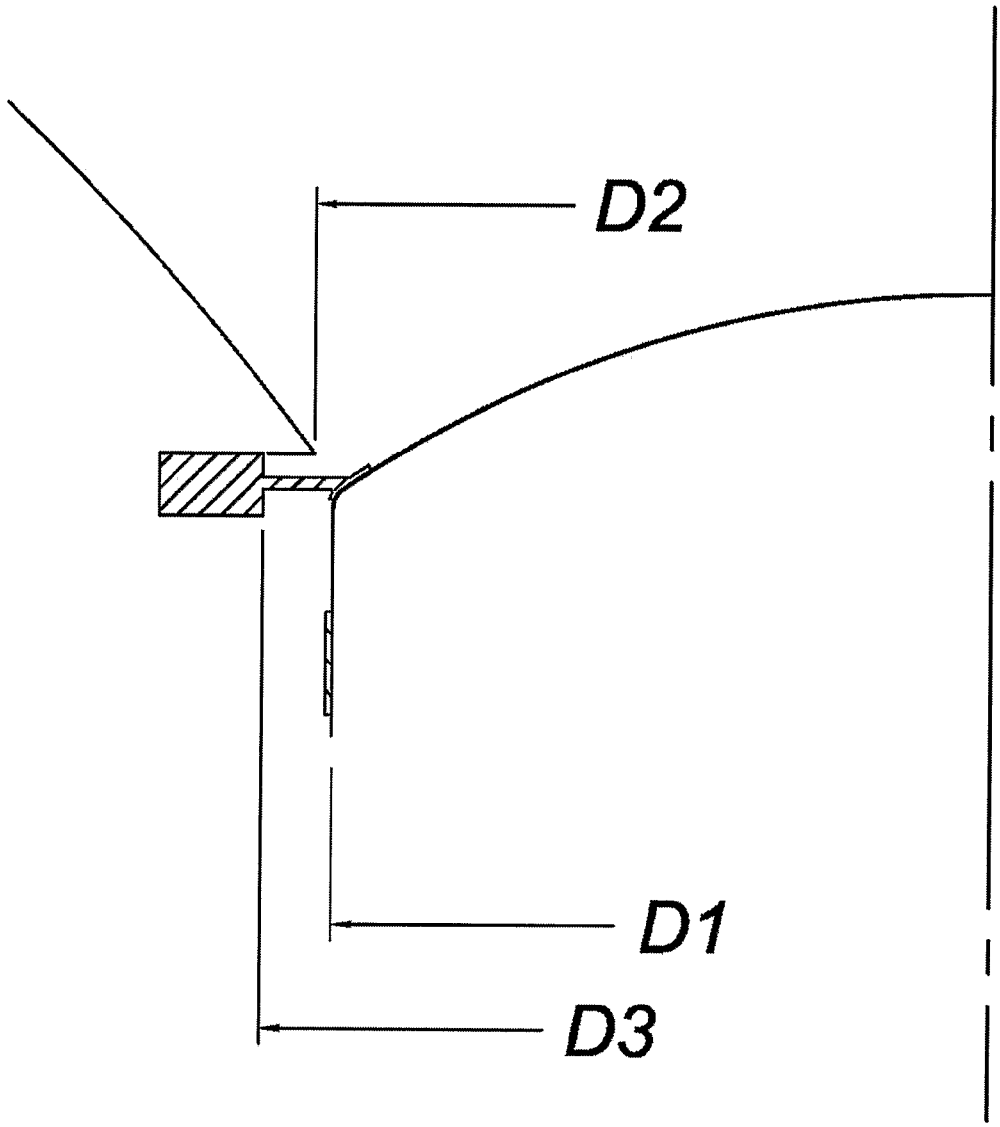
FIGS. 6(*a*) and 6(*b*) illustrate schematically some of the dimensions of preferred loudspeakers according to the invention.
Figure 6B:
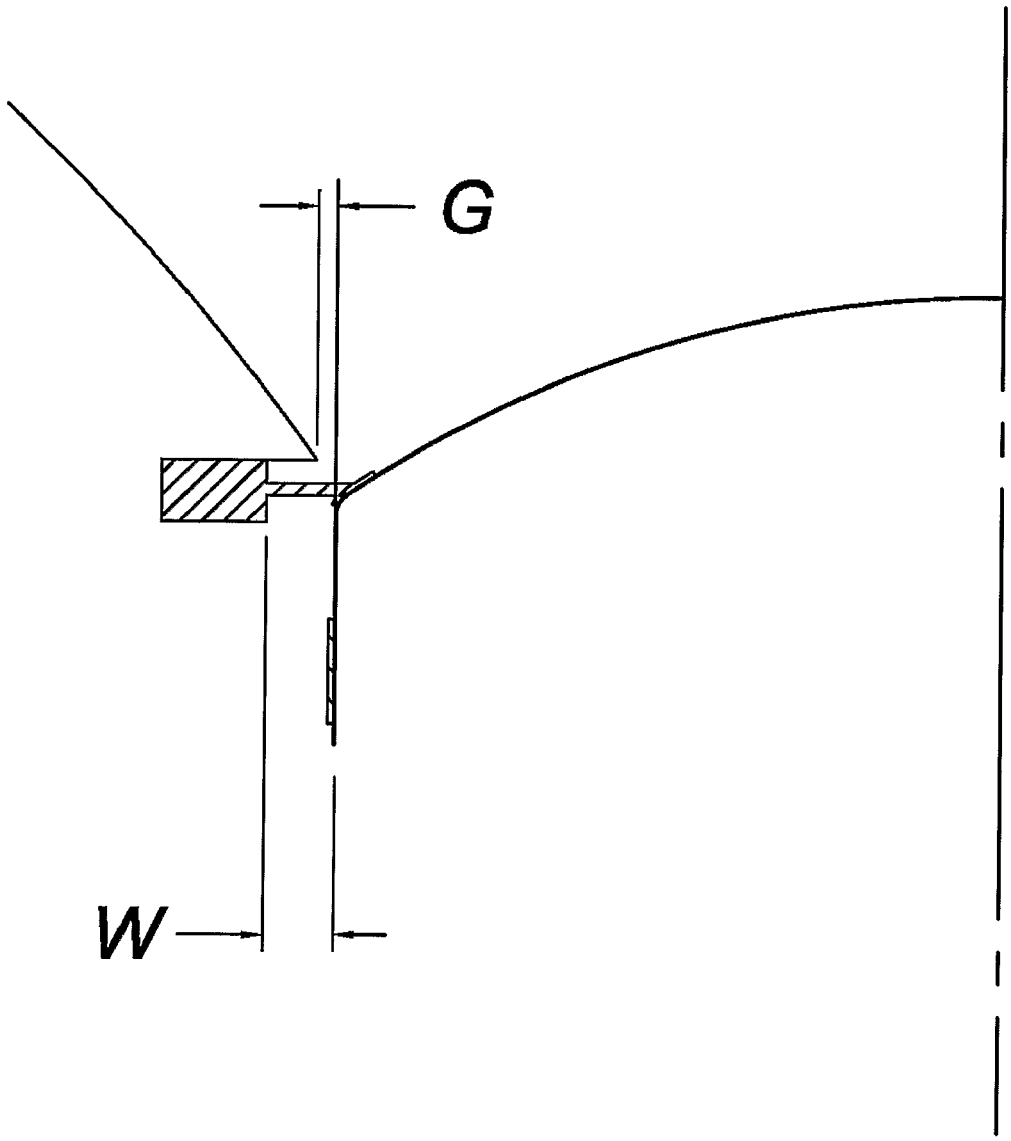

FIGS. 6(*a*) and 6(*b*) illustrate schematically some of the dimensions of preferred loudspeakers according to the invention. FIG. 6(*a*) shows the diameter D1 of the dome-shaped acoustically radiating surface of the transducer, the diameter D2 of the throat of the horn waveguide at the waveguide surface, and the diameter D3 of the support situated around the transducer and to which the surround is attached. FIG. 6(*b*) shows a separation (or gap) G (which is equal to (D2−D1)/2) between the dome-shaped acoustically radiating surface of the transducer and the throat of the horn waveguide at the waveguide surface. FIG. 6(*b*) also shows a separation W (which is equal to (D3−D1)/2) between the dome-shaped acoustically radiating surface of the transducer and the support situated around the transducer. This separation W normally also corresponds to the width of a surround extending between the dome of the transducer and the support.

Figure 7A:
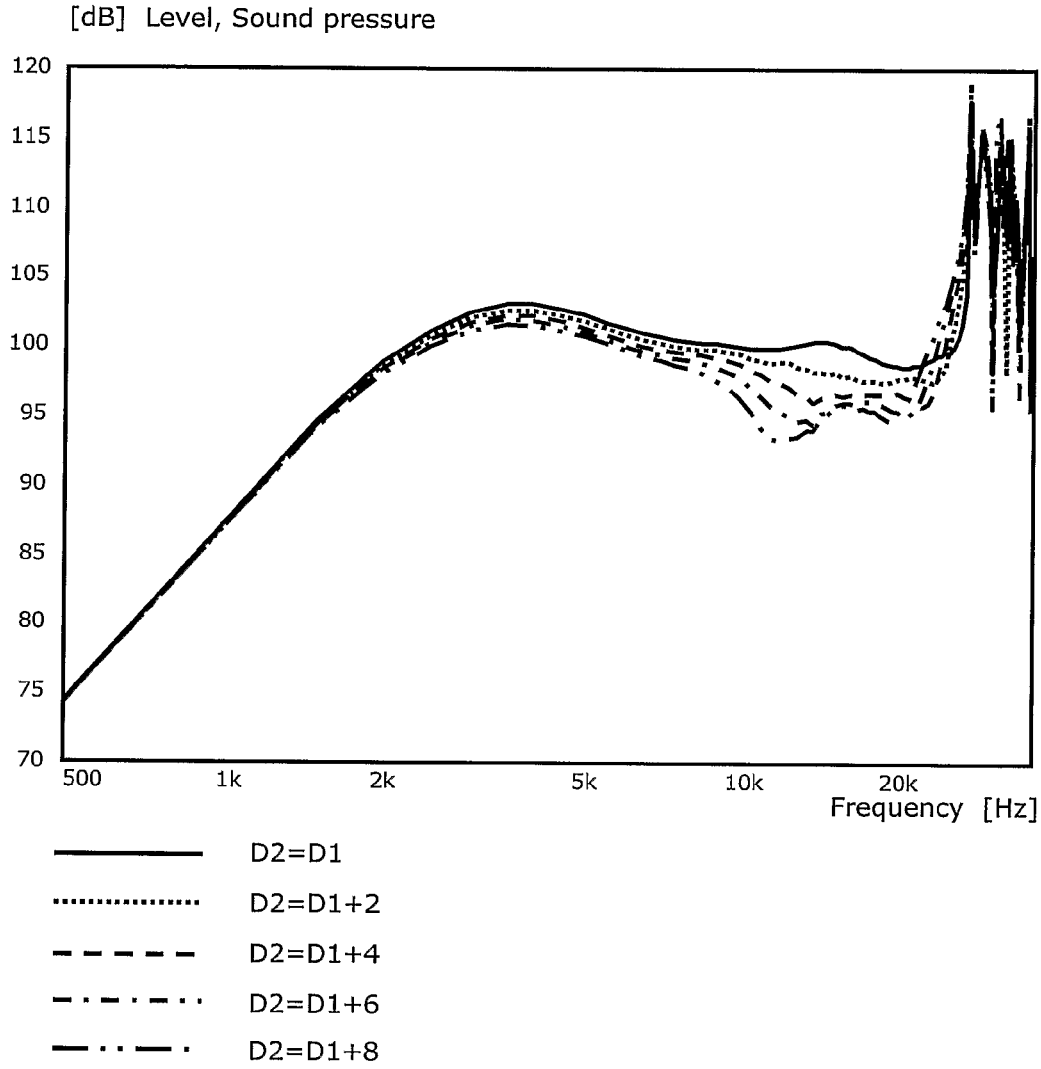
FIGS. 7((*a*) and (*b*)) shows finite element computer modelling results for various relative values of particular dimensions of loudspeakers according to the invention.
Figure 7B:
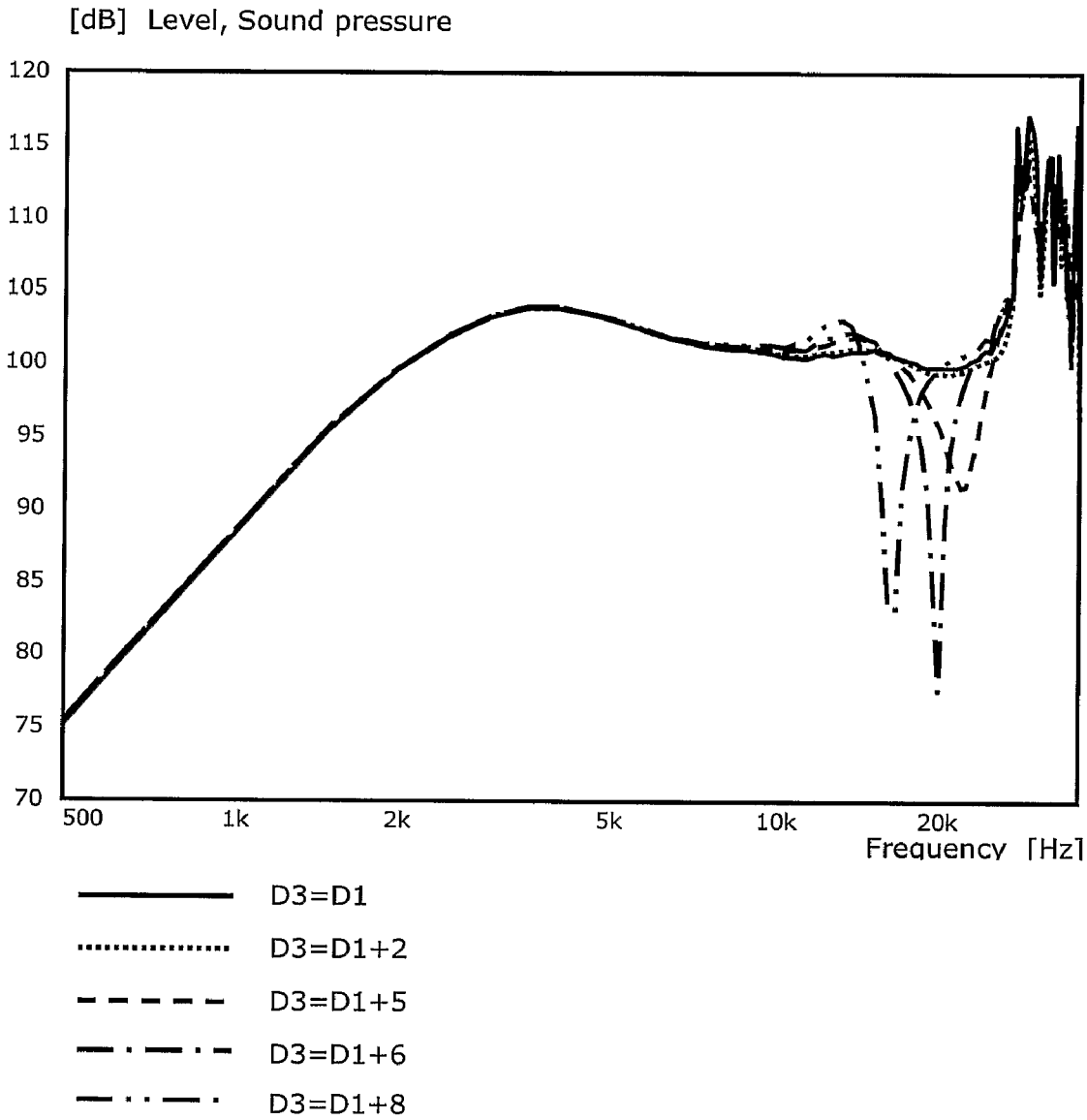

FIGS. 7((*a*) and (*b*)) shows finite element computer modelling results for various relative values of D1, D2 and D3. FIG. 7(*a*) shows the affect of varying the separation G between the throat of the horn waveguide and the dome-shaped surface of the transducer, i.e. (D2−D1)/2. The plots of modelled sound pressure level (SPL, in dB) versus sound frequency (in Hz) show that for separations G of 2 mm or less (i.e. D2−D1 is 4 mm or less) the SPL response is much smoother (i.e. much closer to being constant) than it is for separations G of 3 mm or 4 mm (i.e. D2−D1 is 6 mm or 8 mm) up to at least 20 kHz (which is approximately at, or approaching, the high frequency limit of human hearing).

FIG. 7(*b*) shows the affect of varying the separation W between the support and the dome-shaped surface of the transducer, i.e. (D3−D1)/2. The plots of modelled sound pressure level (SPL, in dB) versus sound frequency (in Hz) show that for separations W of 2.5 mm or less (i.e. D3−D1 is 5 mm or less) the SPL response is much smoother (i.e. much closer to being constant) than it is for separations W of 3 mm or 4 mm (i.e. D3−D1 is 6 mm or 8 mm) up to at least 20 kHz. (It should be noted that although D3=D1 is an ideal acoustical case it is a mechanically difficult (or perhaps impossible) design to achieve.)

Figure 8:
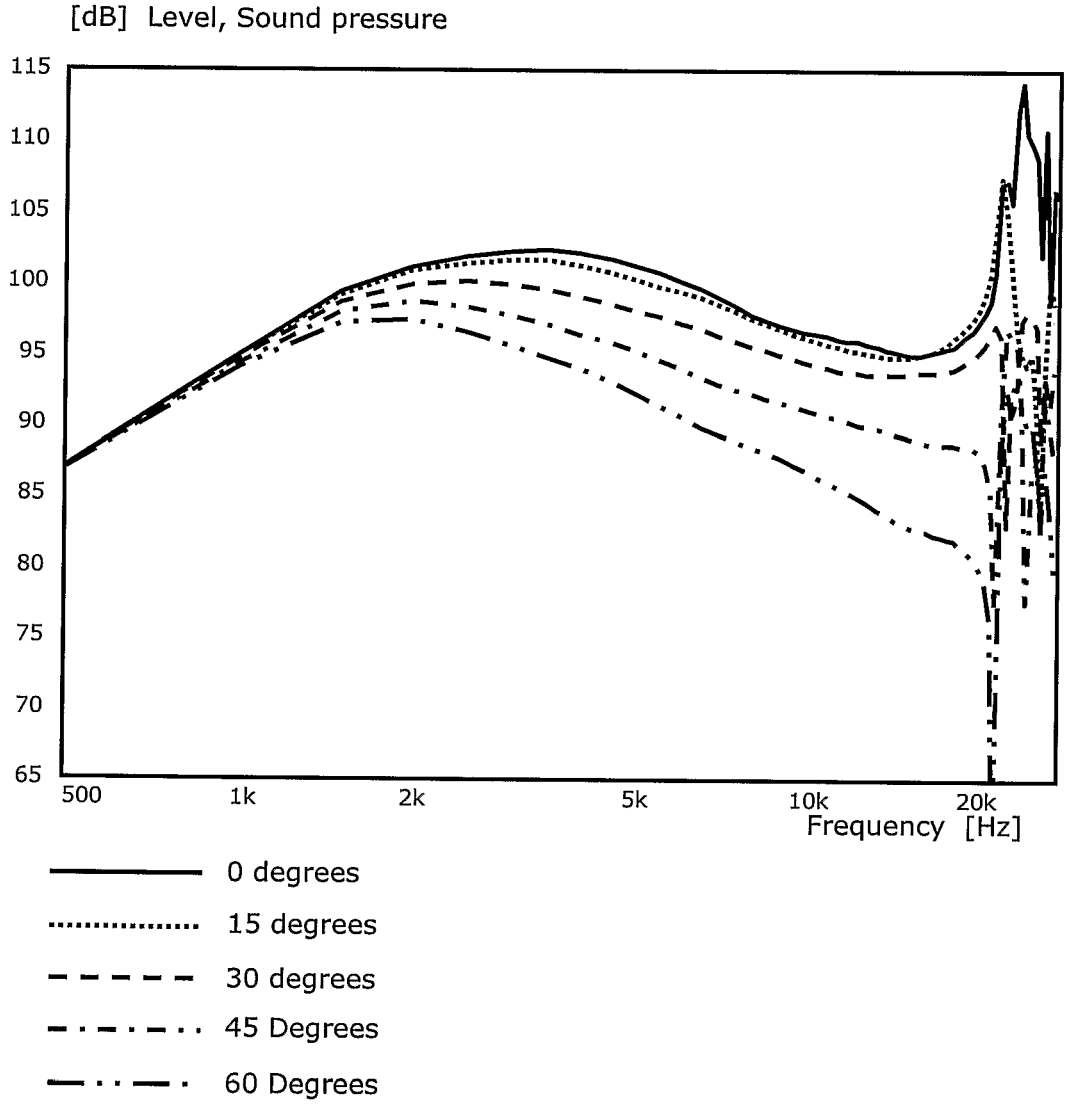
FIG. 8 shows finite element computer modelling results for a particular example of a loudspeaker according to the invention.

FIG. 8 shows finite element computer modelling results for a loudspeaker according to the invention, having a dome-shaped transducer with a diameter of 45 mm in a horn waveguide, having an intersection angle of 87.5 degrees, a horn angle (at the throat) of 40 degrees, and the horn waveguide having an exponential flare with a flare rate implying a cut-on frequency of 2 kHz. (The flare rate relates to the distance taken for the horn area to increase by a fixed factor. For an exponential horn waveguide this distance is substantially constant throughout the length of the horn.) The results show the modelled sound pressure level (in, dB) versus sound frequency (in Hz) at various orientations (angles) with respect to the longitudinal axis of the horn waveguide. The results show that the SPL response is very smooth (i.e. very close to being constant) up to 20 kHz for all orientations from 0 to 60 degrees with respect to the longitudinal axis of the horn waveguide. This means that not only is the SPL response of the loudspeaker consistent up to 20 kHz, the directivity of the loudspeaker is also consistent, i.e. there is little variation in sound pressure angle with variation in direction relative to the loudspeaker. The inventors believe that such results are unlikely to be achieved, if not impossible to achieve, without the present invention.

The invention claimed is:

1. A loudspeaker comprising a horn waveguide having a waveguide surface, and a transducer located at a throat of the horn waveguide, the transducer having a substantially rigid convex dome-shaped acoustically radiating surface, the acoustically radiating surface being non-rigidly coupled to the waveguide surface, wherein:

(a) a horn angle, subtended between a longitudinal axis of the horn waveguide and the waveguide surface at the throat of the horn, is in the range of 20 to 60 degrees; and (b) an intersection angle, subtended between a plane tangential to the dome shape of the acoustically radiating surface and a plane tangential to the waveguide surface at a point where the dome shape or an extrapolation of the dome shape meets the waveguide surface or an extrapolation of the waveguide surface, is in the range of 85 to 110 degrees.

2. A loudspeaker according to claim 1, in which, for horn angles in the range 20 to 40 degrees, the minimum intersection angle is 85 degrees.

3. A loudspeaker according to claim 1, in which, for horn angles in the range from 40 to 50 degrees, the minimum intersection angle varies substantially linearly from 85 to 90 degrees.

4. A loudspeaker according to claim 1, in which, for horn angles in the range from 50 to 60 degrees, the minimum intersection angle varies substantially linearly from 90 to 100 degrees.

5. A loudspeaker according to claim 1, in which, for horn angles in the range from 20 to 45 degrees, the maximum intersection angle varies substantially linearly from 100 to 110 degrees.

6. A loudspeaker according to claim 1, in which, for horn angles in the range 45 to 60 degrees, the maximum intersection angle is 110 degrees.

7. A loudspeaker according to claim 1, in which the dome shape of the acoustically radiating surface of the transducer is substantially a shape of one of a spheroid and a segment of a sphere.

8. A loudspeaker according to claim 1, in which any separation, in a radial direction substantially perpendicular to the longitudinal axis of the horn waveguide, at any point between the throat of the horn waveguide at the waveguide surface and the dome-shaped acoustically radiating surface of the transducer, is no greater than 2.5 mm.

9. A loudspeaker according to claim 1, in which a minimum diameter of the throat of the horn waveguide at the waveguide surface is no more than 5 mm larger than a maximum diameter of the dome-shaped acoustically radiating surface of the transducer.

10. A loudspeaker according to claim 1, in which the dome-shaped acoustically radiating surface of the transducer is attached via a surround to a support situated around the transducer, at least part of the surround being flexible.

11. A loudspeaker according to claim 10, in which the dome-shaped acoustically radiating surface of the transducer is spaced apart from the support situated around the transducer in a radial direction substantially perpendicular to the longitudinal axis of the horn waveguide, by no more than 2.5 mm.

12. A loudspeaker according to claim 10, in which a minimum diameter of the support situated around the transducer is no more than 5 mm larger than a maximum diameter of the dome-shaped acoustically radiating surface of the transducer.

13. A loudspeaker according to claim 1, in which the horn waveguide has an axial length of at least 1.5 times the height of the dome of the transducer.

14. A loudspeaker according to claim 13, in which the horn waveguide has an axial length of at least 2.0 times the height of the dome of the transducer.

15. A loudspeaker according to claim 1, in which the horn waveguide is non-circular in cross-section perpendicular to its longitudinal axis.

16. A loudspeaker according to any one of claim 1, in which the horn waveguide is substantially circular in cross-section perpendicular to its longitudinal axis.

17. A loudspeaker according to claim 1, in which the horn waveguide is substantially frusto-conical.

18. A loudspeaker according to claim 1, in which the horn waveguide is flared.

19. A loudspeaker according to claim 1, in which the horn waveguide comprises a driven acoustically radiating diaphragm.

20. A loudspeaker according to claim 19, in which the diaphragm is driven substantially independently of the dome-shaped transducer.

21. A loudspeaker according to claim 20, in which the diaphragm is arranged to radiate acoustic waves of generally lower frequency than is the dome-shaped transducer.

22. A loudspeaker according to claim 19, in which the diaphragm and the dome-shaped transducer are driven together substantially as a unit.

23. A loudspeaker according to claim 1, further including a drive unit to drive the transducer.

24. A loudspeaker according to claim 1, further including at least one of a plurality of transducers and a plurality of driven acoustically radiating diaphragms.

25. A loudspeaker system comprising a plurality of loudspeakers, wherein each of the plurality of loudspeakers comprises:

a horn waveguide having a waveguide surface, and a transducer located in, or adjacent to, a throat of the horn waveguide, the transducer having a substantially rigid convex dome-shaped acoustically radiating surface, the acoustically radiating surface being non-rigidly coupled to the waveguide surface, wherein:

(a) a horn angle, subtended between a longitudinal axis of the horn waveguide and the waveguide surface at the throat of the horn, is in the range of 20 to 60 degrees; and (b) an intersection angle, subtended between a plane tangential to the dome shape of the acoustically radiating surface and a plane tangential to the waveguide surface at a point where the dome shape or an extrapolation of the dome shape meets the waveguide surface or an extrapolation of the waveguide surface, is in the range of 85 to 110 degrees.

* * * * *